US010132150B2

(12) United States Patent
Richards

(10) Patent No.: US 10,132,150 B2
(45) Date of Patent: Nov. 20, 2018

(54) IN-WELL SALINE FLUID CONTROL

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 49 days.

(21) Appl. No.: 15/115,027

(22) PCT Filed: Jun. 23, 2014

(86) PCT No.: PCT/US2014/043617
§ 371 (c)(1),
(2) Date: Jul. 28, 2016

(87) PCT Pub. No.: WO2015/199641
PCT Pub. Date: Dec. 30, 2015

(65) Prior Publication Data

US 2016/0348491 A1 Dec. 1, 2016

(51) Int. Cl.

| | |
|---|---|
| ***E21B 43/34*** | (2006.01) |
| ***E21B 43/12*** | (2006.01) |
| ***E21B 43/38*** | (2006.01) |
| ***F15C 1/00*** | (2006.01) |
| ***F15D 1/00*** | (2006.01) |
| ***E21B 43/08*** | (2006.01) |

(52) U.S. Cl.
CPC ..... *E21B 43/34* (2013.01); *E21B 43/08* (2013.01); *E21B 43/12* (2013.01); *E21B 43/38* (2013.01); *F15C 1/00* (2013.01); *F15D 1/00* (2013.01)

(58) Field of Classification Search
CPC ..... E21B 34/12; E21B 34/08; E21B 43/34; E21B 43/38
See application file for complete search history.

(56) References Cited

U.S. PATENT DOCUMENTS

| | | | |
|---|---|---|---|
| 8,931,566 B2 | 1/2015 | Dykstra et al. | |
| 2011/0024122 A1* | 2/2011 | Ballard | E21B 21/00 166/310 |

(Continued)

FOREIGN PATENT DOCUMENTS

| | | |
|---|---|---|
| EP | 2392770 A2 | 12/2011 |
| WO | WO2012158575 A2 | 11/2012 |

OTHER PUBLICATIONS

Knust, Kyle N., et al. "Electrochemically Mediated Seawater Desalination." Angewandte Chemie International Edition, Wiley-VCH Verlag, Jun. 19, 2013, onlinelibrary.wiley.com/doi/10.1002/anie.201302577/abstract. (Year: 2013).*

(Continued)

*Primary Examiner* — David J Bagnell
*Assistant Examiner* — Tara E Schimpf
(74) *Attorney, Agent, or Firm* — Scott Richardson; Parker Justiss, P.C.

(57) ABSTRACT

A well tool includes a body defining an enclosed fluid passage. A bipolar electrode is provided in the well tool, changeable between a first, energized state, and a second, different state. The bipolar electrode in the first state produces an ion depletion zone that presents a flow restriction to saline fluids in the fluid passage.

22 Claims, 3 Drawing Sheets

(56) References Cited

U.S. PATENT DOCUMENTS

| | | | | |
|---|---|---|---|---|
| 2012/0111577 | A1 | 5/2012 | Dykstra et al. | |
| 2012/0300000 | A1* | 11/2012 | Panchawagh | B41J 2/08 347/76 |
| 2013/0092394 | A1* | 4/2013 | Holderman | E21B 43/08 166/373 |
| 2013/0180727 | A1 | 7/2013 | Dykstra et al. | |
| 2014/0216934 | A1* | 8/2014 | Fu | C02F 1/4695 204/519 |
| 2015/0027722 | A1* | 1/2015 | Al-Mulhem | E21B 43/122 166/372 |
| 2015/0159472 | A1* | 6/2015 | Wolf | E21B 43/08 166/313 |

OTHER PUBLICATIONS

Knust et al., "Electrochemically Mediated Seawater Desalination," Angewandte Communications, DOI: 10.1002/anie.201302577, published in 2013, 3 pages.

PCT International Search Report and Written Opinion of the International Searching Authority, PCT/US2014/043617, dated Mar. 20, 2015, 17 pages.

* cited by examiner

+

IN-WELL SALINE FLUID CONTROL

CROSS-REFERENCE TO RELATED APPLICATIONS

This application is a U.S. National Phase Application under 35 U.S.C. § 371 and claims the benefit of priority to International Application Serial No. PCT/US2014/043617, filed on Jun. 23, 2014, the contents of which are hereby incorporated by reference.

BACKGROUND

Saline fluids, including brine, are produced as a byproduct of producing oil and natural gas. Saline fluids are also used in many aspects of drilling, completing and treating wells, as well as an injection fluid to enhance production from subterranean zones. After use, these fluids are circulated back to the surface or produced along with the naturally occurring saline fluids.

Once produced or retrieved at the surface, the saline fluids must be disposed of. Disposal of naturally occurring saline fluids often includes transporting the saline fluids to another location for re-injection into a disposal formation. Sometimes the fluids are treated, and provided to other uses. Sometimes the fluids are left to evaporate in an evaporation pond. In any instance, however, disposal is a cost burden to the well. The cost burden is compounded by tightening environmental regulations that are increasingly making disposal more difficult and costly.

In addition to disposal, saline fluids present other problems. In particular, saline fluid production through the well displaces production of oil and gas. For example, sometimes an amount of saline fluids must be produced out of the subterranean zone before oil and gas production can start in earnest. Continued production of saline fluids over the life of the well delays recovery of the oil and gas, because it displaces volume in the fluid flow to the surface. The resulting delay in the economic recovery of the well can be significant.

Therefore, many techniques have been developed to control production of saline fluids.

DESCRIPTION OF DRAWINGS

Like reference symbols in the various drawings indicate like elements.

DETAILED DESCRIPTION

Figure 1:
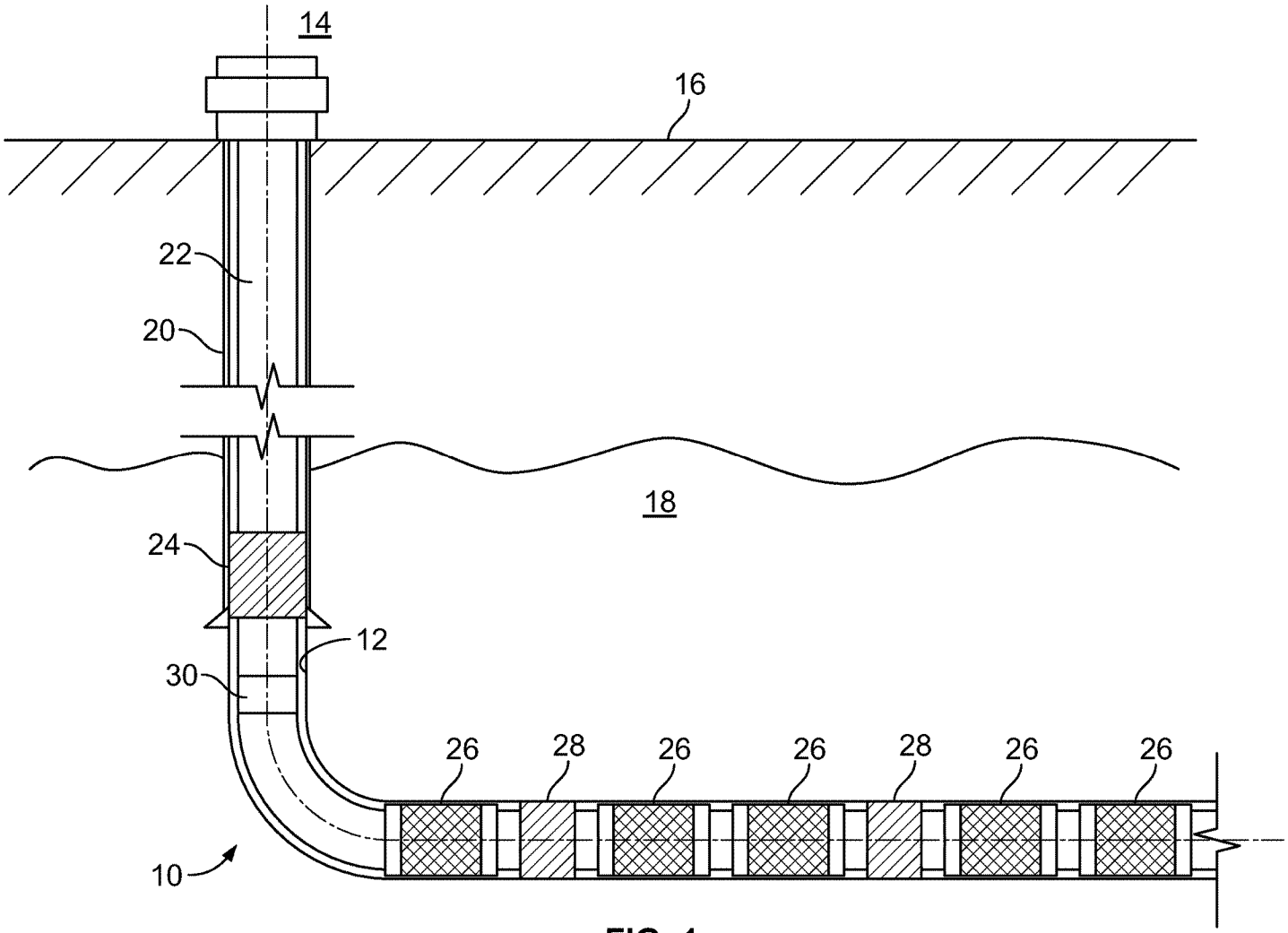
FIG. 1 is a schematic side cross sectional view of an example well system.

FIG. 1 shows an example well system 10 for use in understanding the concepts described herein. The well system 10 includes a substantially cylindrical wellbore 12 that extends from a wellhead 14 at the terranean surface 16, downward into the Earth, into a subterranean zone of interest 18. The subterranean zone can coincide with a target formation, a portion of a formation or multiple formations. A portion of the wellbore 12 extending from the wellhead 14 to the subterranean zone 18 is lined with lengths of tubing called casing 20. The remainder of the wellbore 12 is open hole. In other instances, the entire wellbore 12 is lined with casing 20, or the entire wellbore 12 is open hole.

The depicted wellbore 12 is a non-vertical deviating wellbore and particularly a horizontal wellbore, having a substantially vertical portion that extends from the surface 16 to the subterranean zone 18, and a substantially horizontal portion in the subterranean zone 18. Although discussed herein in connection with a horizontally deviated wellbore 12, the concepts herein are applicable to other configurations of wellbores 12. Some examples include multilaterals, wellbores that deviate to a slant, wellbores that undulate and/or other configurations.

In completing the well system 10, a tubular completion string 22 is run into the wellbore 12 to a specified final depth where the completion string 22 will remain after commissioning and during operation of the well system 10 in producing resources, such as oil and gas, from the subterranean zone 18. Then, the completion string 22 is tied back to the casing 20 and/or to the wellhead 14 at the surface 16 with a liner hanger and/or completion packer 24 that seals against flow from the annulus between the wellbore 12 and the completion string 22. Once the completion string 22 is positioned in the wellbore 12, drilling fluids and other solids are displaced from the wellbore 12 to the surface by circulating clean brine or other completion fluids into the well.

In certain instances, the completion string 22 includes one or more well screen assemblies 26 positioned below the liner hanger/completion packer 24. The well screen assembles 26 allow fluid to flow from the subterranean zone 18 into the center bore of the completion string 22 and to the surface 16, yet filter against particulate of a specified size and larger. Packers 28 are provided between well screen assemblies 26 to define multiple fluidically isolated production intervals.

Each of the well screen assemblies 26 defines an enclosed fluid passage or multiple enclosed fluid passages between the exterior of the completion string 22 and its central bore. One or more of well screen assemblies 26 can include a system for controlling flow of saline fluids, such as brine, saline treatment fluids and/or other saline fluids produced from the subterranean zone 18 or provided into the well 10 from the surface 16. All or a subset of the enclosed fluid passages between the exterior of the completion string 22 and its central bore of a given well screen assembly 26 can be provided with the system. When actuated, the system provides a greater flow restriction to saline fluids than to non-saline fluids through the enclosed fluid passage. In certain instances, the system blocks the passage of salts, desalinizing fluids that pass through the passage.

In certain instances, the system includes a bipolar electrode that when energized, produces an ion depletion zone in the enclosed fluid passages. The ion depletion zone blocks (entirely or substantially) salts from passing through the enclosed fluid passages, and creates a flow restriction with more resistance to saline fluids than without the ion depletion zone. Non-saline fluids are able to pass the ion depletion zone. The bipolar electrode can be de-energized to cease the ion depletion zone, and thus the resistance to saline fluids provided by the ion depletion zone. The bipolar electrode can be energized in on/off pulses, on a duty cycle of less than 1 or less than 0.5, to produce less restriction than its full restriction to saline fluids. Power for the bipolar electrode can be provided from the surface on an electrical cable and/or can be provided from a location in the wellbore 12, for example, from a downhole battery, a downhole generator (e.g., powered by fluid flow, heat, and/or other source), and/or from a power delivery tool wirelessly coupled to the bipolar electrode (e.g., via an inductive coupling and/or otherwise). Notably, the system does not have any moving parts. If the system fails, it will likely default to a fail-safe state in which it does not filter saline fluids.

In the context of production, the well screen assemblies 26 can be made to filter against saline fluids, and pass only non-saline fluids or pass a greater amount of non-saline fluids (whether originally non-saline or desalinized by the system) than saline fluids. Therefore, the fluids flowing into the central bore of the completion string 22 and to the surface 16 will have a reduced amount of saline fluid, or all salts can be blocked. For example, the well screen assemblies 26 will filter brine produced from the subterranean zone 18 in favor of producing oil and gas; in certain instances, the water production of the well 10 will be reduced.

The well screen assemblies 26 include a system for controlling flow of saline fluids that can be selectively actuated to control the flow of saline fluids at different locations along the completion string 22. For example, the system for controlling flow of saline fluids can be actuated in one or more well screen assemblies 26 in a production zone (i.e., between an adjacent set of packers 26) to provide a restriction to, and thus reduce, the flow of saline fluids into the central bore from that production zone. Different production intervals can have a different number of well screen assemblies 26 actuated to provide a restriction to saline fluids, or none actuated, to provide different restriction to flow of saline fluids in different production intervals.

In the context of injecting saline fluids, the well screen assemblies 26 can be selectively actuated to control the injection of saline fluids at different locations along the completion string 22. For example, the system for controlling flow of saline fluids can be actuated in selected well screen assemblies 26 to produce a specified injection flow profile along the length of the completion string 22 and/or to different production intervals.

During circulating completion fluids, the well screen assemblies 26 can be actuated to desalinate completion fluids before being circulated back to the surface, increasing the salinity, and thus weight, of the completion fluids remaining in the wellbore 12. As a result, heavier completion fluids could be achieved in-situ without needing additives. Also, reducing the salinity of the completion fluids circulated to the surface can make disposal of the completion fluids easier, from an environmental standpoint, and cheaper.

Other components 30 in the completion string 22 or elsewhere in the well system 10 can alternately or additionally include enclosed fluid passages and include systems for controlling flow of saline fluids through the enclosed fluid passages. For example, the component 30 (provided in a completion string with or without well screen assemblies 26) can be a flow control device controlling the flow of saline fluids between the exterior of the completion string 22 and the center bore of the completion string 22, or controlling the flow of saline fluids between locations internal to the completion string 22. Also, although the concepts herein are described in the context of a completed well system 10 with a completion string 22, they are also applicable in a drilling context, incorporated into flow control devices in a drilling string, and a well treatment or workover context, incorporated into flow control devices in a working string (e.g., a fracturing string, an injection string, and/or another type of working string).

Figure 2:
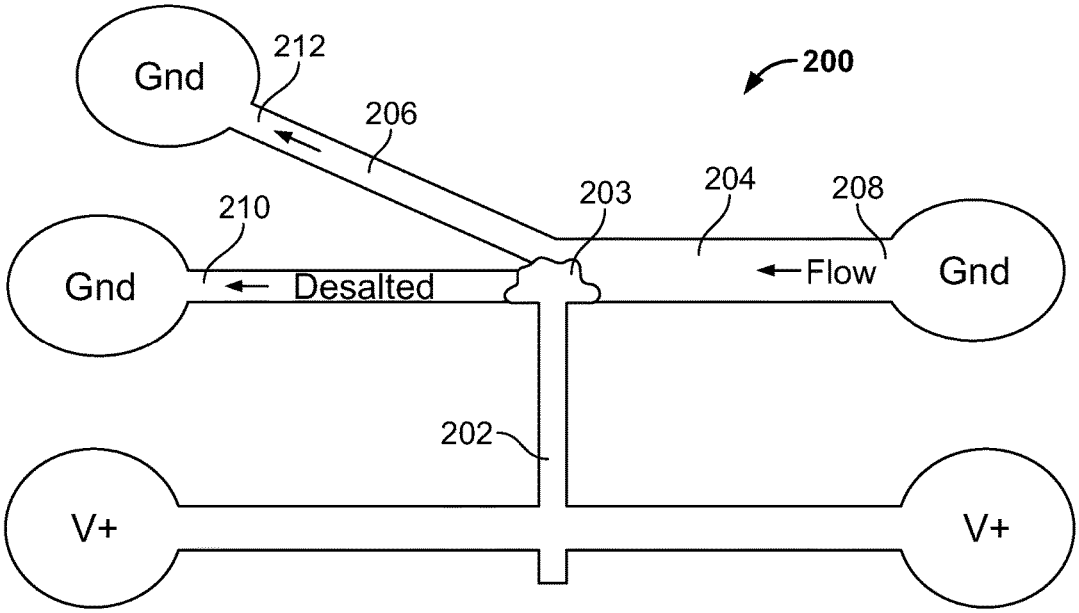
FIG. 2 is a schematic cross sectional view of an example system for controlling flow of saline fluids.

Referring now to FIG. 2, an example of a system 200 for controlling flow of saline fluids is depicted. The example system 200 includes a bipolar electrode 202 that, when energized, generates an ion depletion zone 203 in an enclosed fluid passage 204 containing saline fluids. The ion depletion zone 203 rejects ions present in saline fluids, and allows passage of non-saline fluids, desalinizing and passing a portion of the saline fluids, past the ion depletion zone 203 and onward through the enclosed fluid passage 204. The rejected saline fluids are redirected to a side branch 206, and can be recycled back into the enclosed fluid passage 204 or otherwise disposed of. Thus, the enclosed fluid passage 204 receives saline fluids at an inlet 208 and passes non-saline fluids (including desalinized fluids) to an outlet at 210. A remainder of the saline fluids is passed to a second outlet 212. An example system that can be used as the system 200 is described in Knust, K. N., Hlushkou, D., Anand, R. K., Tallarek, U. and Crooks, R. M. (2013), *Electrochemically Mediated Seawater Desalination*. Angew. Chem. Int. Ed., 52: 8107-8110.

Figure 3:
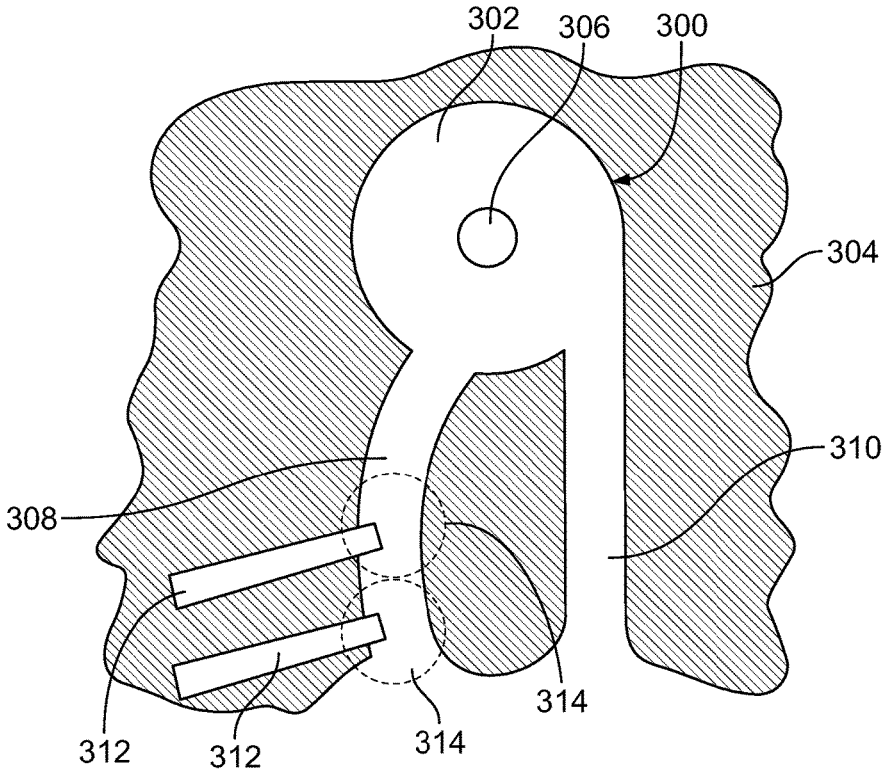
FIG. 3 is a cross sectional view of an example fluid diode.

FIG. 3 shows an example fluid diode-based flow control device 300 employing a system for controlling flow of saline fluids, such as the example system 200 described above. The flow control device 300 includes a fluid diode 302 that presents different flow restrictions to fluids of different fluid characteristics. For example, the fluid diode 302 can be arranged to more readily pass fluids based on their viscosity, velocity, and/or density, as well as how the fluids enter the fluid diode 302. The example flow control device 300 can be employed in a number of different applications within or outside of a well, including to control flow between an interior and exterior of a well string, to control flow between a subterranean zone an interior of a casing, to control flow through a well screen assembly, to control flow through the interior of a tubing such as well string or casing, and/or other applications.

In the example of FIG. 3, the fluid diode 302 is depicted as a generally disk-shaped cavity in a solid body 304. The depicted fluid diode 302 has a central outlet 306 and two inlets, a direct inlet 308 and an indirect inlet 310. The direct inlet 308 is oriented more directly towards the outlet 306 than the indirect inlet 310, to direct fluid entering the fluid diode 302 via the direct inlet 308 in a trajectory more directly towards the outlet 306 than fluid entering the fluid diode 302 via the indirect inlet 310. The indirect inlet 310 is oriented to direct fluid entering the fluid diode 302 via the indirect inlet 310 to circulate around the interior of the disk-shaped cavity before reaching the outlet 306. Thus, fluid entering the fluid diode 302 through the direct inlet 308 is thus presented with less restriction to flow through the fluid diode 302, because it flows more directly towards the outlet 306. Fluid entering the fluid diode 302 through the indirect inlet 310 is thus presented with a greater restriction to flow through the fluid diode 302 because it flows more indirectly towards the outlet 306. In certain instances, a fluid switch or other flow control device can be provided upstream of the inlets 308, 310 to direct fluids having certain characteristics through the direct inlet 308 and other fluids through the indirect inlet 310. For example, in certain instances, a flow of primarily oil and gas may be directed towards the direct inlet 308, while a flow of primarily water (typically brine and/or other saline fluid) may be directed towards the indirect inlet 310. As a result, the fluid diode 302 tends to more readily pass oil and gas than water.

One or both of the inlets 308, 310 can be provided with a system for controlling flow of saline fluids. FIG. 3 shows two bipolar electrodes 312 in a sidewall of the direct inlet 308. The bipolar electrodes 312 generate ion depletion zones 314 in the direct inlet 308 tending to reject passage of saline fluids through the direct inlet 308. Therefore, any saline fluids entrained with the oil and gas directed toward direct inlet 308 will be rejected, and redirected towards the indirect inlet 310. As a result, the fluids passed into the interior of the fluid diode 302 from the direct inlet 308 will have a lower saline fluid content, and more oil and gas will be directed toward the outlet 306 of the fluid diode 302. Notably, although two bipolar electrodes 312 are depicted in the inlet 308, one or three or more could be provided in either or both of the inlets 308, 310. Also, other types of fluid diodes exist and can be used in the concepts herein. U.S. Pat. No. 8,657,017, entitled "Method and Apparatus for Autonomous Downhole Fluid Selection with Pathway Dependent Resistance System," discloses some other possible examples of types of fluid diodes.

Figure 4A:
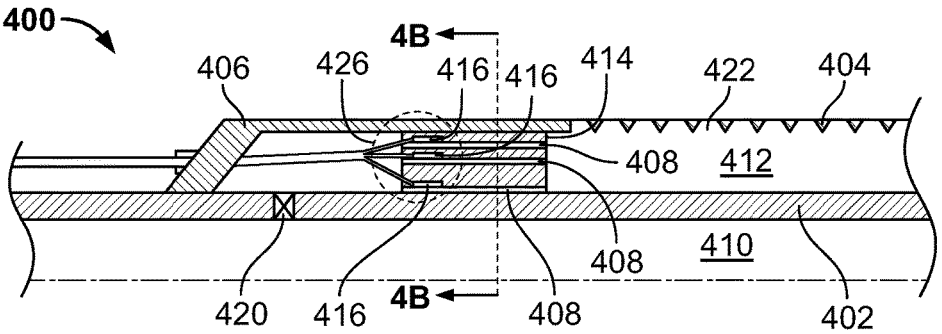
FIG. 4A is a partial, half cross sectional view of an example well screen assembly.
Figure 4B:
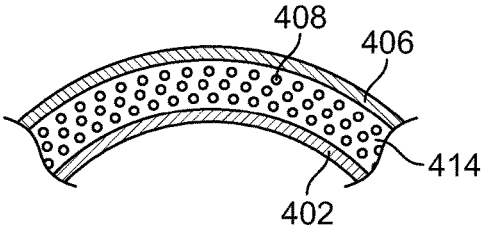
FIG. 4B is a partial, detail cross sectional view of a flow discriminator of the well screen assembly of FIG. 4A taken along line 4B-4B of FIG. 4A.

FIG. 4A is a partial, half cross-sectional view of an example well screen assembly 400 incorporating a system for controlling flow of saline fluids. The well screen assembly 400 can be used as one or more of the well screen assemblies 26. The well screen assembly 400 includes a generally tubular base pipe 402 adapted to couple in-line with the remainder of a tubing string, such that a central bore 410 of the base pipe 402 coincides with the central bore of the remainder of the tubing string. The base pipe 402 carries one or more layers of filtration screen 404 encircling the exterior of the base pipe 402. The filtration screen 404 has apertures 422 sized to filter against particulate of a specified size or larger into an annular space 412 between the filtration screen 404 and the exterior of the base pipe 402. The filtration screen 404 is affixed to and sealed at its ends to end rings 406 encircling the base pipe 402 (one shown) and the end rings 406 are affixed to and sealed to the exterior of the base pipe 402. All flow between the annular space 412 and the central bore 410 passes through at least one end ring 406. The end ring 406 includes a body 414 that defines one or more enclosed fluid passages 408 (a plurality are shown) fluidically positioned between the annular space 412 and the central bore 410. When a plurality of fluid passages 408 are provided, they can be spaced apart around the circumference of the base pipe 402. FIG. 4B shows an example arrangement of fluid passages 408, but other arrangements are possible. The body 414 is affixed to and sealed to the end ring 406 and the base pipe 402, so that all flow must pass through the enclosed fluid passages 408. One or more of the enclosed fluid passages 408 include respective bipolar electrodes 416 that, when energized, generate an ion depletion zone 426 in the enclosed fluid passage 408. As above, the ion depletion zone 426 provides a greater flow restriction to saline fluids through the enclosed fluid passages 408 than to non-saline fluids. The body 414 with the bipolar electrodes 416 and enclosed fluid passages 408, thus forms a fluid discriminator that presents a higher restriction to passing saline fluids than to non-saline fluids when the bipolar electrodes 416 are energized. The well screen assembly 400 can be actuated to pass more oil and gas (and other non-saline fluids) than saline fluids (e.g. naturally occurring brine). The non-discriminated fluids flow out of the body 414 and into the central bore 410. In certain instances, an additional flow control device 420 can be provided in a fluid passage between the body 414 and the central bore 410 of the base pipe 402, to allow additional control of the flow properties through the well screen assembly 400. The flow control device 420 is fluidically positioned between the body 414 and the central bore 410. In certain instances, the flow control device 420 can include a fluid diode-based device, such as described with respect to FIG. 3, that produces additional restriction to passing water over oil and gas.

Figure 4C:
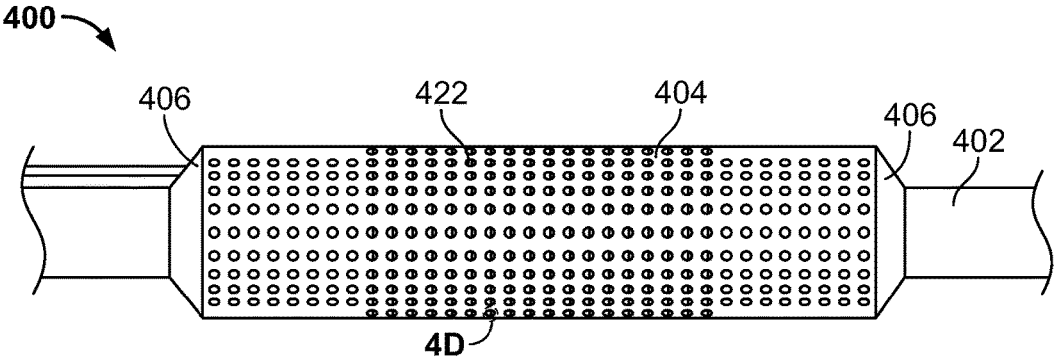
FIG. 4C is an orthogonal view of the well screen assembly of FIG. 4A.
Figure 4D:
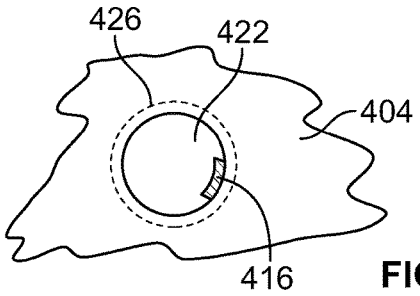
FIG. 4D is a detail view of a filtration aperture of the well screen assembly of FIG. 4C.

In addition to or as an alternative to providing the fluid discriminator (i.e., the body 414, enclosed fluid passages 408 and bipolar electrodes 416) in an end ring 406, the filtration screen 404 itself can be arranged to act as a fluid discriminator. For example, as shown in FIG. 4C, the filtration screen 404 defines a body and the filtration apertures 422 define a plurality of enclosed fluid passages between the exterior of the well screen assembly 400 and the annular space 412. One or more of these respective enclosed fluid passages defined by the filtration apertures 422 can be provided with a bipolar electrode 416 that generates an ion depletion zone 426 in at least the enclosed fluid passage defined by the aperture 422. As above, the ion depletion zone 426 provides a greater flow restriction to saline fluids than to non-saline fluids through the enclosed fluid passage 422. The result is that the well screen assembly 400 will tend to pass more oil and gas (and other non-saline fluids) than saline fluids (e.g., naturally occurring brine).

The concepts herein encompass a well tool having a body defining an enclosed fluid passage. A bipolar electrode is provided in the well tool, changeable between a first, energized state, and a second, different state. The bipolar electrode in the first state produces an ion depletion zone that presents a flow restriction to saline fluids in the fluid passage.

The concepts additionally encompass a method where fluids comprising saline fluids are received in an enclosed fluid passage in a subterranean well. An ion depletion zone is generated in the enclosed fluid passage to restrict flow of the saline fluids through the fluid passage.

The concepts additionally encompass a system for controlling saline fluids in a well. The system includes a body defining a flow passage and an ion depletion zone generator. The ion depletion zone generator, when energized, generates an ion depletion zone in the flow passage to present a flow restriction to saline fluids.

The concepts above encompass some, none, or all of the following features. In certain instances, the body defines an inlet fluid passage and a plurality of outlet fluid passages. The bipolar electrode, when in the energized state, produces an ion depletion zone in fewer than all of the outlet fluid passages. In certain instances, the body includes a plurality of bipolar electrodes associated with at least a subset of the enclosed fluid passages. In certain instances, the body defines a fluid diode having two inlet fluid passages. The bipolar electrode, when in the energized state, produces an ion depletion zone in at least one of the inlet fluid passages. In certain instances, the fluid diode includes a generally disk-shaped cavity having a central outlet in the cavity. One of the two inlet fluid passages is directed more towards the central outlet than the other of the two inlet fluid passages. In certain instances the well tool comprises a well screen assembly having a base pipe and a filtration screen encircling the base pipe. The filtration screen has filtration apertures sized to filter against particulate of a specified size and larger into an annular space between the filtration screen and the base pipe. In certain instances, the filtration screen includes the body, and the enclosed fluid passage includes one or more filtration apertures in the filtration screen. In certain instances, the body is disposed so that the fluid passage is fluidically positioned between the annular space and a central bore of the base pipe.

A number of embodiments have been described. Nevertheless, it will be understood that various modifications may be made. Accordingly, other embodiments are within the scope of the following claims.

The invention claimed is:

1. A well tool for use within a wellbore, comprising:

a body defining an enclosed fluid passage, the passage comprising at least two adjacent inlets and a plurality of outlet fluid passages; and a bipolar electrode changeable between a first, energized state, and a second, different state, the bipolar electrode in the first state produces an ion depletion zone that presents a flow restriction to saline fluids in the fluid passage;

wherein the bipolar electrode is positioned at least partially within at least one of the at least two adjacent inlets, and where the bipolar electrode, when in the energized state, produces an ion depletion zone in fewer than all of the outlet fluid passages.

2. The well tool of claim 1, where the body defines a fluid diode; and where the bipolar electrode, when in the energized state, produces the ion depletion zone in at least one of the at least two adjacent inlet fluid passages.

3. The well tool of claim 2, where the fluid diode comprises a generally disk-shaped cavity having a central outlet in the cavity, where one of the two inlet fluid passages is directed more toward the central outlet than the other of the two inlet passages.

4. The well tool of claim 1, where the well tool comprises a well screen assembly comprising a base pipe and a filtration screen encircling the base pipe, the filtration screen having filtration apertures sized to filter against particulate of a specified size and larger into an annular space between the filtration screen and the base pipe; and where the filtration screen comprises the body and the enclosed fluid passage comprises one or more filtration apertures in the filtration screen.

5. The well tool of claim 1, where the well tool comprises a well screen assembly comprising a base pipe and a filtration screen encircling the base pipe, the filtration screen having filtration apertures sized to filter against particulate of a specified size and larger into an annular space between the filtration screen and the base pipe; and where the body is disposed so that the fluid passage is fluidically positioned between the annular space and a central bore of the base pipe.

6. The well tool of claim 5, comprising a flow control device fluidically positioned between the body and the central bore of the base pipe.

7. The well tool of claim 1, where the body comprises a plurality of enclosed fluid passages of which the first-mentioned enclosed fluid passage is a part, and the well tool comprises a plurality of bipolar electrodes associated with at least a subset of the enclosed fluid passages.

8. The well tool of claim 1, where, in the second state, the bipolar electrode is not energized and produces no ion depletion zone in the fluid passage.

9. The well tool of claim 1, comprising a second bipolar electrode changeable between a first, energized state, and a second, different state, where the second bipolar electrode in the first state produces an ion depletion zone that presents a flow restriction to saline fluids in the fluid passage.

10. The well tool of claim 1, where the body defines a second enclosed fluid passage; and the well tool comprises a second bipolar electrode changeable between a first, energized state, and a second, different state, where the second bipolar electrode in the first state produces an ion depletion zone that presents a flow restriction to saline fluids in the second enclosed fluid passage.

11. A method, comprising:

receiving fluids comprising saline fluids in an enclosed fluid passage in a subterranean well, the fluid passage comprising at least two adjacent inlets and a plurality of outlet fluid passages; and generating an ion depletion zone in fewer than all of the outlet fluid passages by energizing a bipolar electrode positioned at least partially within at least one of the two adjacent inlets in the enclosed fluid passage that restricts flow of the saline fluids through the enclosed fluid passage.

12. The method of claim 11, where receiving fluids in an enclosed fluid passage in a subterranean well comprises receiving fluids into a central bore of a well screen assembly through the enclosed fluid passage, where the well screen assembly comprises the enclosed fluid passage.

13. The method of claim 12, where the enclosed fluid passage comprises a plurality of filtration apertures in a filtration screen of the well screen assembly.

14. The method of claim 12, where the well screen assembly comprises an end ring with a fluid passage between a filtration screen of the screen assembly and the central bore of the screen assembly, and the enclosed fluid passage resides in the end ring.

15. The method of claim 11, where the received fluids comprise completion fluids comprising saline fluids, and where the method comprises removing non-saline fluids from the completion fluids.

16. The method of claim 11, where the enclosed fluid passage comprises an inlet to a fluid diode.

17. The method of claim 11, where generating an ion depletion zone further comprises energizing a second bipolar electrode.

18. The method of claim 11, where energizing the bipolar electrode comprises energizing the bipolar electrode in on/off pulses having a duty cycle less than 1.

19. The method of claim 11, comprising generating more than one ion depletion zone.

20. A system for controlling saline fluids in a wellbore, comprising:

a body configured for use within the wellbore defining a flow passage, the body including two adjacent inlets and a plurality of outlet fluid passages; and an ion depletion zone generator positioned at least partially within at least one of the two adjacent inlets that, when energized, generates an ion depletion zone in fewer than all of the outlet fluid passages of the flow passage to present a flow restriction to saline fluids.

21. The system of claim 20, where the ion depletion zone generator comprises a bipolar electrode.

22. The system of claim 20, comprising a well screen comprising the body.

* * * * *